US011319196B2

(12) United States Patent
Takaoka

(10) Patent No.: US 11,319,196 B2
(45) Date of Patent: May 3, 2022

(54) INTERMEDIATE SUPPORT HOLDER FOR CONSTRUCTION MACHINERY

(71) Applicant: KOBELCO CONSTRUCTION MACHINERY CO., LTD., Hiroshima (JP)

(72) Inventor: Daisuke Takaoka, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 49 days.

(21) Appl. No.: 16/768,994

(22) PCT Filed: Nov. 13, 2018

(86) PCT No.: PCT/JP2018/041906

§ 371 (c)(1),
(2) Date: Jun. 2, 2020

(87) PCT Pub. No.: WO2019/111642

PCT Pub. Date: Jun. 13, 2019

(65) Prior Publication Data

US 2021/0171323 A1 Jun. 10, 2021

(30) Foreign Application Priority Data

Dec. 6, 2017 (JP) ..... JP2017-234163

(51) Int. Cl.
*B66C 23/82* (2006.01)
*B66C 23/36* (2006.01)
*B66C 23/26* (2006.01)

(52) U.S. Cl.
CPC ..... *B66C 23/82* (2013.01); *B66C 23/36* (2013.01); *B66C 23/26* (2013.01)

(58) Field of Classification Search
CPC ..... B66C 23/00; B66C 23/60; B66C 23/62; B66C 23/64; B66C 23/82; B66C 23/821
See application file for complete search history.

(56) References Cited

U.S. PATENT DOCUMENTS 4,353,471 A 10/1982 Palmer
10,280,049 B2 * 5/2019 Albinger ..... B66C 23/70
(Continued)

FOREIGN PATENT DOCUMENTS

CN 101525108 A 9/2009
CN 202022678 U 11/2011
(Continued)

OTHER PUBLICATIONS

Machine Translation of CN 202657871U. (Year: 2013).*
(Continued)

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

An intermediate support holder includes right and left guy line retaining units, right and left intermediate support line retaining units, and a connecting unit. The intermediate portions of the guy lines can be attached to the guy line retaining units. The intermediate support line retaining units are disposed so as to be aligned in the right-left direction with respect to the guy line retaining units, and base end portions of the intermediate support lines can be attached to the intermediate support line retaining units. The connecting unit couples and fixes the pair of right and left guy line retaining units and the pair of right and left intermediate support line retaining units to each other.

3 Claims, 9 Drawing Sheets

(56) References Cited

U.S. PATENT DOCUMENTS

| | | | | |
|---|---|---|---|---|
| 2005/0194339 | A1* | 9/2005 | Willim | B66C 23/82 212/300 |
| 2011/0132860 | A1* | 6/2011 | Bohnacker | B66C 23/82 212/262 |
| 2015/0203338 | A1* | 7/2015 | Albinger | B66C 23/821 52/651.07 |
| 2018/0319636 | A1* | 11/2018 | Albinger | B66C 23/70 |

FOREIGN PATENT DOCUMENTS

| | | | |
|---|---|---|---|
| CN | 202657871 | U | 1/2013 |
| CN | 102556861 | B | 5/2014 |
| CN | 203639013 | U | 6/2014 |
| CN | 203754303 | U | 8/2014 |
| CN | 107082378 | A | 8/2017 |
| JP | 10-120371 | A | 5/1998 |
| JP | 11-292472 | A | 10/1999 |
| JP | 2016-204121 | A | 12/2016 |
| JP | 2017-503733 | A | 2/2017 |

OTHER PUBLICATIONS

Extended European Search Report dated Dec. 3, 2020 in European Patent Application No. 18886898.8, 8 pages.
International Search Report dated Dec. 11, 2018 in PCT/JP2018/041906 filed Nov. 13, 2018, 2 pages.

* cited by examiner

INTERMEDIATE SUPPORT HOLDER FOR CONSTRUCTION MACHINERY

TECHNICAL FIELD

The present invention relates to an intermediate support holder for a construction machine.

BACKGROUND ART

Patent Literature 1 (see FIG. 1) discloses an intermediate support line that connects a derricking member (a boom in the literature) for a construction machine and a guy line with each other. FIGS. 2A to 2E in the literature disclose states of work of attaching an intermediate support line to a guy line.

CITATION LIST

Patent Literature

Patent Literature 1: JP 2016-204121A

SUMMARY OF INVENTION

In the technique disclosed in the literature, the intermediate support line is attached to the guy line in a manner such that the intermediate support line extends from the guy line toward the derricking member side. Thus, at the time of this attaching work, there is a need to secure a work space between the guy line and the derricking member. However, when a guy line is placed on a derricking member that has been laid down on the ground at the stage of assembling and disassembling work of a construction machine, for example, it is difficult to secure such a work space. Thus, the work of attaching the intermediate support line to the guy line is difficult, and the attaching work may take labor. Furthermore, a construction machine is generally provided with a pair of right and left guy lines and a pair of right and left intermediate support lines (two lines are respectively provided). Thus, it is necessary to perform the work of attaching the intermediate support line to the guy line on both the right and left sides, which takes labor.

It is an object of the present invention to provide an intermediate support holder for a construction machine, the intermediate support holder being capable of easily attaching an intermediate support line to a guy line even if there is not a sufficient work space between the guy line and the derricking member.

The present invention provides an intermediate support holder for a construction machine, the intermediate support holder being configured to be mounted in a construction machine including: a derricking member that includes a derricking member base end portion, a derricking member tip end portion opposite to the derricking member base end portion, and a derricking member intermediate portion located between the derricking member base end portion and the derricking member tip end portion and is supported at a body so as to be able to derrick; a derricking device that has a pair of right and left guy lines each including a guy line tip end portion connected with the derricking member tip end portion of the derricking member, a guy line base end portion opposite to the guy line tip end portion, and a guy line intermediate portion located between the guy line base end portion and the guy line tip end portion and causes the derricking member to derrick; and a pair of right and left intermediate support lines that each have an intermediate support base end portion coupled to the guy line intermediate portion of each of the guy lines, and an intermediate support tip end portion coupled to the derricking member intermediate portion of the derricking member and connect the pair of right and left guy line intermediate portions and the derricking member intermediate portion with each other. The intermediate support holder includes: a pair of right and left guy line retaining units that can respectively retain the guy line intermediate portions of the pair of right and left guy lines; a pair of right and left intermediate support line retaining units that are respectively disposed adjacent to the pair of right and left guy line retaining units in a right-left direction and can respectively retain the intermediate support base end portions of the pair of right and left intermediate support lines; and a connecting unit that connects the pair of right and left guy line retaining units and the pair of right and left intermediate support line retaining units with each other along the right-left direction.

DESCRIPTION OF EMBODIMENTS

Figure 1:
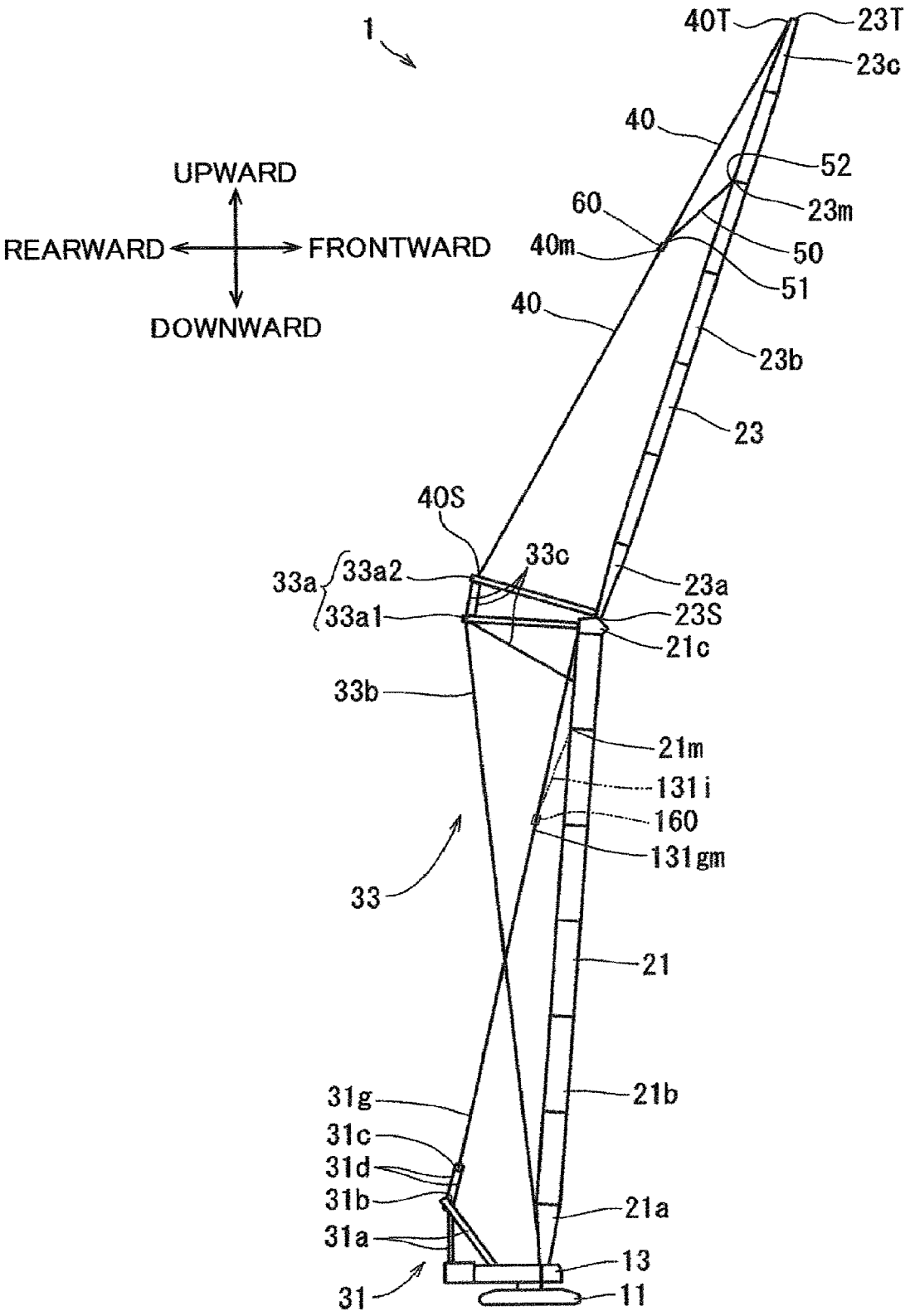
FIG. 1 is a side view of a construction machine in which an intermediate support holder according to an embodiment of the present invention is mounted.
Figure 2:
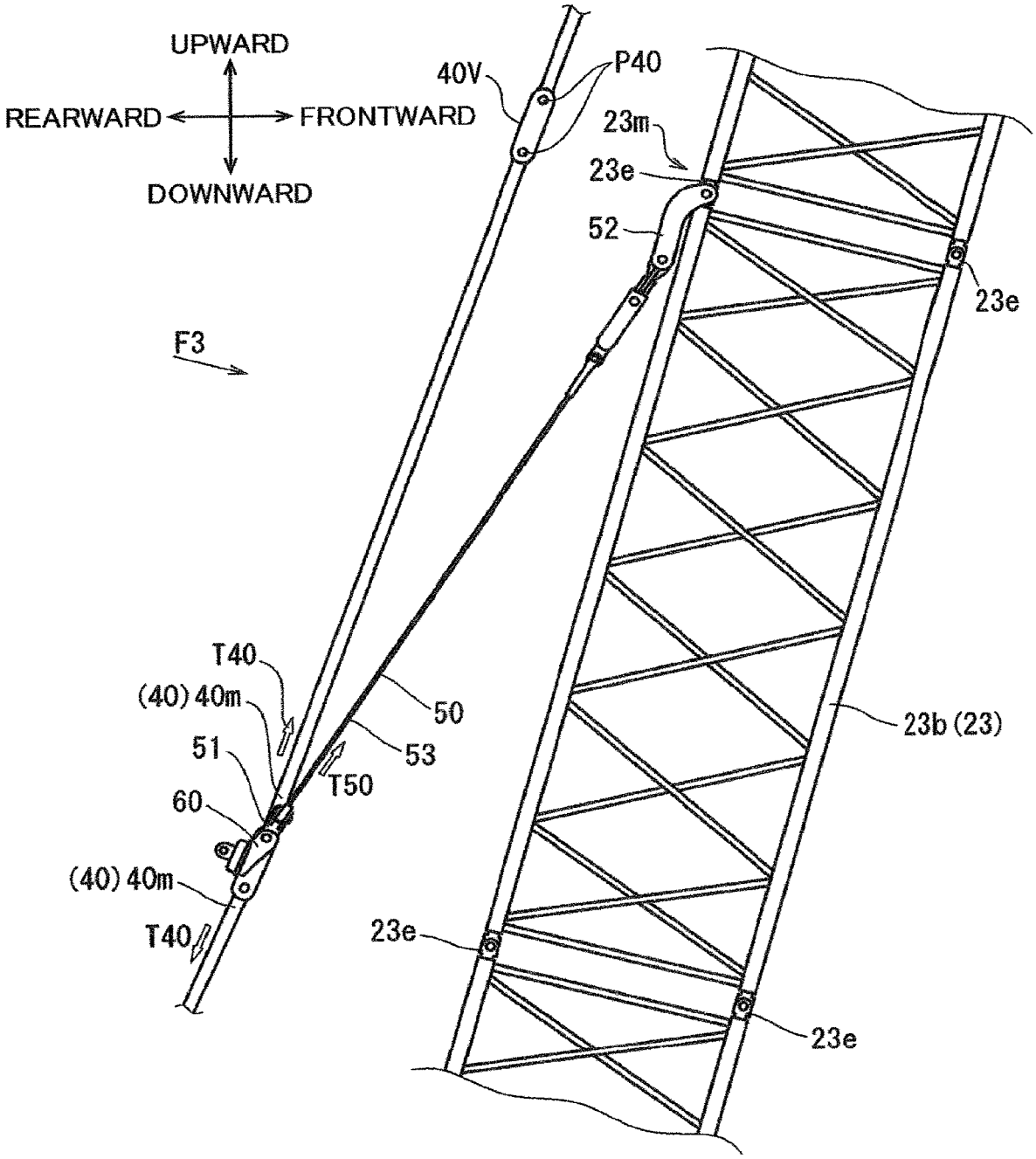
FIG. 2 is an enlarged side view in which the periphery of an intermediate support line of the construction machine illustrated in FIG. 1 is enlarged.

With reference to FIGS. 1 to 9, a crane 1 (construction machine) having an intermediate support bracket 60 (intermediate support holder) according to an embodiment of the present invention will be described. FIG. 1 is a side view of the crane 1 in which the intermediate support bracket 60 according to the present embodiment is mounted. FIG. 2 is an enlarged side view in which the periphery of a jib intermediate support line 50 (intermediate support line) of the crane 1 illustrated in FIG. 1 is enlarged.

The crane 1 is a construction machine that performs works such as lifting a load. The crane 1 includes a lower travelling body 11, an upper slewing body 13, a boom 21 (a derricking member, an attachment), a jib 23 (a derricking member, an attachment), a boom support member 31, and a jib support member 33.

The lower travelling body 11 is a part that allows the crane 1 to travel, and may include a crawler or a wheel. The upper slewing body 13 is loaded on the lower travelling body 11 and can slew with respect to the lower travelling body 11.

The boom 21 is attached to the upper slewing body 13 so as to be able to derrick. The boom 21 is a lattice boom having a lattice structure. The boom 21 has a plurality of components (boom members constituting the boom 21) coupled to each other along the longitudinal direction (axial direction) in which the boom 21 extends. The components constituting the boom 21 include a lower boom 21*a* closest to the base end side, an intermediate boom 21*b*, and an upper boom 21*c* closest to the tip end side, in this order from the base end side (upper slewing body 13 side) to the tip end side (opposite to the upper slewing body 13 side). The intermediate boom 21*b* has a plurality of components coupled to each other.

The jib 23 is attached to the tip end portion (upper boom 21*c*) of the boom 21 so as to be able to freely derrick, so that the jib 23 is supported by the upper slewing body 13 via the boom 21 so as to be able to derrick. The above "end portion" means an end and a part near an end (the same applies hereinafter). The jib 23 is a lattice jib having a lattice structure. The jib 23 has a plurality of components (jib members constituting the jib 23) coupled to each other along the longitudinal direction (axial direction) in which the jib 23 extends. The components constituting the jib 23 are coupled at connectors 23*e* (see FIG. 2) by pins (the same applies to the boom 21). The components constituting the jib 23 include a lower jib 23*a* closest to the base end side, an intermediate jib 23*b*, and an upper jib 23*c* closest to the tip end side, in this order from the base end side (upper boom 21*c* side) to the tip end side (opposite to the upper boom 21*c* side). The intermediate jib 23*b* has a plurality of components coupled to each other. The jib 23 includes a jib base end portion 23S (derricking member base end portion), a jib tip end portion 23T (derricking member tip end portion) opposite to the jib base end portion 23S, and a jib intermediate portion 23*m* (derricking member intermediate portion) located between the jib base end portion 23S and the jib tip end portion 23T. The jib intermediate portion 23*m* is located at the intermediate jib 23*b*. Among the surfaces constituting the jib 23, a surface facing the jib guy line 40 (guy line) is defined as the rear surface of the jib 23.

As illustrated in FIG. 1, the boom support member 31 supports the boom 21 from behind, and causes the boom 21 to derrick with respect to the upper slewing body 13. The boom support member 31 includes a gantry 31*a*, a lower spreader 31*b*, an upper spreader 31*c*, a boom derricking rope 31*d*, and a pair of right and left boom guy lines 31*g* (guy lines).

The gantry 31*a* is a structure that is attached and fixed to the upper slewing body 13. The lower spreader 31*b* is provided at a tip end portion of the gantry 31*a*. The upper spreader 31*c* is disposed at a position higher than the lower spreader 31*b*. The boom derricking rope 31*d* is attached to (hung from) the lower spreader 31*b* and the upper spreader 31*c*. The boom guy lines 31*g* are attached (linked) to the upper spreader 31*c* and a tip end portion (upper boom 21*c*) of the boom 21. The pair of right and left boom guy lines 31*g* are provided at an interval from each other in the right-left direction Y. The right-left direction Y is a width direction of the boom 21 and is a direction of the rotation axis of the boom 21 with respect to the upper slewing body 13 (a direction in which the rotation axis extends). The right-left direction Y is also a width direction of the jib 23 and is also a direction of the rotation axis of the jib 23 with respect to the boom 21. A winch (not shown) winds and unwinds the boom derricking rope 31*d*, thereby changing the interval between the lower spreader 31*b* and the upper spreader 31*c*. As a result, the boom 21 derricks with respect to the upper slewing body 13. It is to be noted that a mast that can derrick with respect to the upper slewing body 13 may be provided instead of the gantry 31*a*. In this case, the boom guy lines 31*g* are disposed to connect a tip end portion of the mast and a tip end portion of the boom 21 with each other.

The jib support member 33 (derricking device) supports the jib 23 from behind, and causes the jib 23 to derrick with respect to the boom 21. The jib support member 33 includes a strut 33*a*, a strut guy line 33*b*, a jib derricking rope 33*c*, a pair of right and left jib guy lines 40, a pair of right and left jib intermediate support lines 50 (intermediate support lines), and the intermediate support bracket 60 (intermediate support holder). The jib support member 33 is connected with the jib 23 by the pair of right and left jib guy lines 40 and causes the jib 23 to derrick.

The strut 33*a* is attached to at least one of the upper boom 21*c* and the lower jib 23*a* so as to be able to derrick. The strut 33*a* includes a rear strut 33*a*1 and a front strut 33*a*2. The rear strut 33*a*1 is attached to the upper boom 21*c* so as to be able to derrick. The front strut 33*a*2 is attached to a base end portion of the lower jib 23*a* so as to be able to derrick. The front strut 33*a*2 may be attached to the upper boom 21*c* so as to be able to derrick. When the crane 1 is in a working posture, the front strut 33*a*2 is disposed at a position higher than the rear strut 33*a*1. It is to be noted that only one strut 33*a* may be provided.

The strut guy line 33*b* is attached (linked) to a tip end portion of the rear strut 33*a*1 (an end portion opposite to the upper boom 21*c* side) and to a lower portion of the boom 21 (or the upper stewing body 13). The jib derricking rope 33*c* is hung from a sheave of a tip end portion of the rear strut 33*a*1 and from a sheave of a tip end portion of the front strut 33*a*2 (an end portion opposite to the lower jib 23*a* side).

The pair of right and left jib guy lines 40 (guy lines) are attached (linked) to a tip end portion of the front strut 33*a*2 and to a tip end portion of the jib 23. The pair of right and left jib guy lines 40 are provided at an interval from each other in the right-left direction Y (see FIG. 3). A winch (not shown) winds and unwinds the jib derricking rope 33*c*, thereby changing the interval between a tip end portion of the rear strut 33*a*1 and a tip end portion of the front strut 33*a*2. As a result, the jib 23 derricks with respect to the boom 21. It is to be noted that a mode may be employed in which the interval between the tip end portion of the front strut 33*a*2 and the tip end portion of the rear strut 33*a*1 is constant, and the strut 33*a* can derrick with respect to the boom 15.

Each jib guy line 40 has at least one of a link member (guy link) and a wire rope (guy rope). In the example illustrated in FIG. 2 and the like, each jib guy line 40 is a jib guy link constituted of link members. As illustrated in FIG. 1, each of the pair of right and left jib guy lines 40 includes: a jib guy line tip end portion 40T (guy line tip end portion) connected with the jib tip end portion 23T of the jib 23; a jib guy line base end portion 40S (guy line base end portion) opposite to the jib guy line tip end portion 40T; and a jib guy line intermediate portion 40*m* (guy line intermediate portion) located between the jib guy line base end portion 40S and the jib guy line tip end portion 40T. The jib guy line intermediate portion 40*m* is a part between a base end portion (jib guy line base end portion 40S, an end portion on the front strut 33*a*2 side) and a tip end portion (jib guy line tip end portion 40T, an end portion on the tip end portion side of the jib 23) of the jib guy line 40.

The pair of right and left jib intermediate support lines 50 (intermediate support lines) are attached to the jib guy line intermediate portions 40*m* and the jib intermediate portion 23*m* (connect the pair of right and left jib guy line intermediate portions 40*m* and the jib intermediate portion 23*m* with each other). The pair of right and left jib intermediate support lines 50 are provided at an interval from each other in the right-left direction Y (see FIG. 3). Each jib intermediate support line 50 has at least one of a link member (guy link) and a wire rope (guy rope). In the example illustrated in FIG. 2 and the like, each jib intermediate support line 50 has a link member and a wire rope. For example, each jib intermediate support line 50 includes an intermediate support base end member 51 (intermediate support base end portion), an intermediate support tip end member 52 (intermediate support tip end portion), and an intermediate support intermediate member 53.

Figure 3:
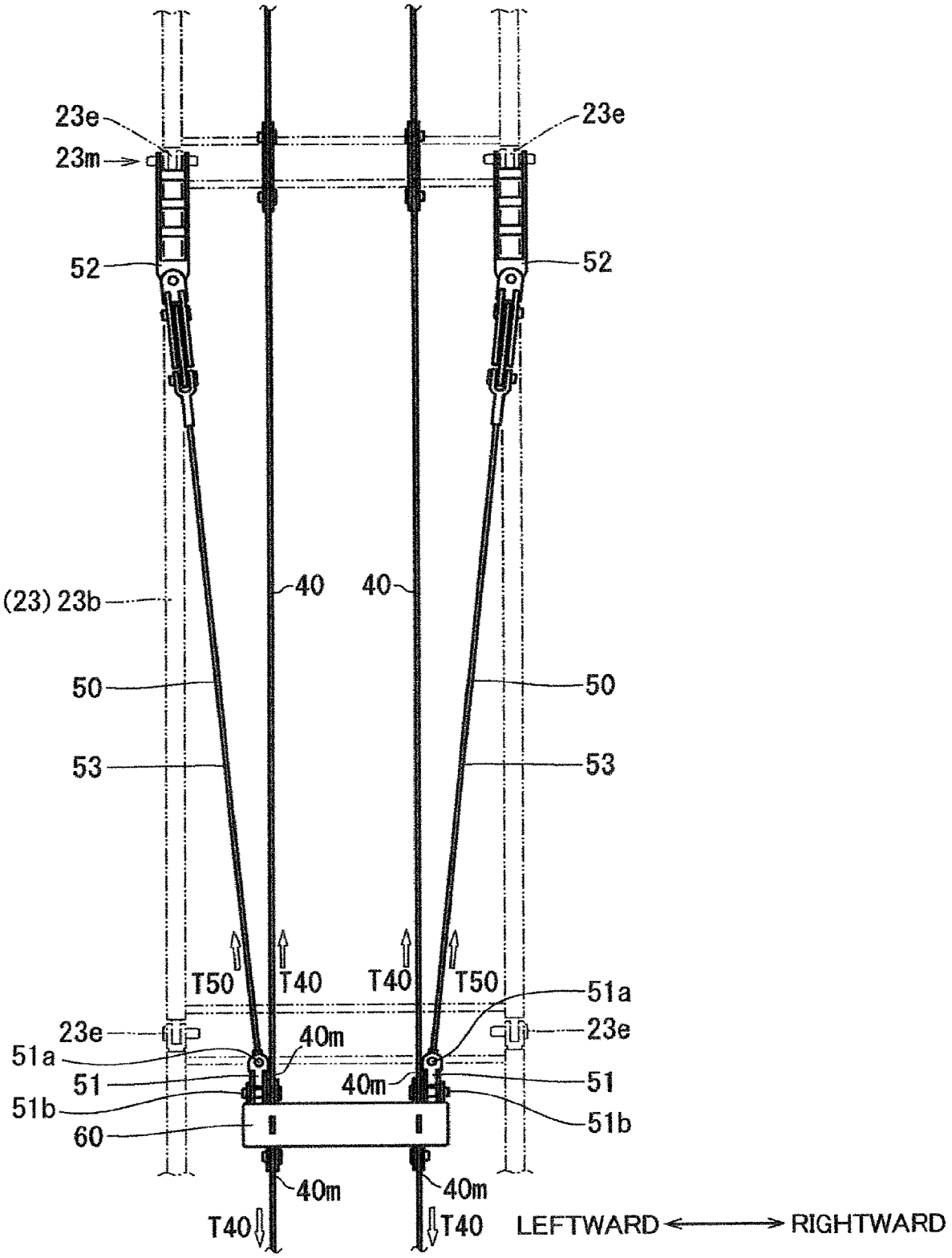
FIG. 3 is a view of the construction machine illustrated in FIG. 2 as viewed along arrow F3.

Each intermediate support base end member 51 is provided at a base end portion of a jib intermediate support line 50 (an end portion on the intermediate support bracket 60 side) and is coupled to a jib guy line intermediate portion 40*m* of a jib guy line 40. As illustrated in FIGS. 2 and 3, each intermediate support base end member 51 is a link member (cross link) into which two orthogonal pins 51*a* and 51*b* are inserted. Since the intermediate support base end members 51 are cross links as illustrated in FIG. 3, the jib intermediate support lines 50 can be disposed in a manner such that the interval between the two jib intermediate support lines 50 in the right-left direction Y is widened from the intermediate support bracket 60 toward the tip end side (jib intermediate portion 23*m* side).

Each intermediate support tip end member 52 is provided at a tip end portion of a jib intermediate support line 50 (an end portion on the jib intermediate portion 23*m* side) and is coupled to the jib intermediate portion 23*m* of the jib 23. In the example illustrated in FIG. 4, each intermediate support tip end member 52 includes link members, for example, a banana-shaped link 52*a* and a length adjustment cross link 52*b*. The banana-shaped link 52*a* is attached to a connector 23*e*. Each length adjustment cross link 52*b* includes a plurality of pin holes 52*c* (FIG. 4) for adjusting the length of a jib intermediate support line 50. The length adjustment cross links 52*b* are cross links (similar to the intermediate support base end members 51).

As illustrated in FIG. 3, each intermediate support intermediate member 53 is attached to an intermediate support tip end member 52 and an intermediate support base end member 51 (connects the intermediate support tip end member 52 and the intermediate support base end member 51 with each other). Each intermediate support intermediate member 53 has a wire rope (see FIG. 5). It is to be noted that the configurations (the number of link members, presence or absence of a wire rope, and the like) of the intermediate support base end members 51, the intermediate support tip end members 52, and the intermediate support intermediate members 53 may be changed.

Figure 6:
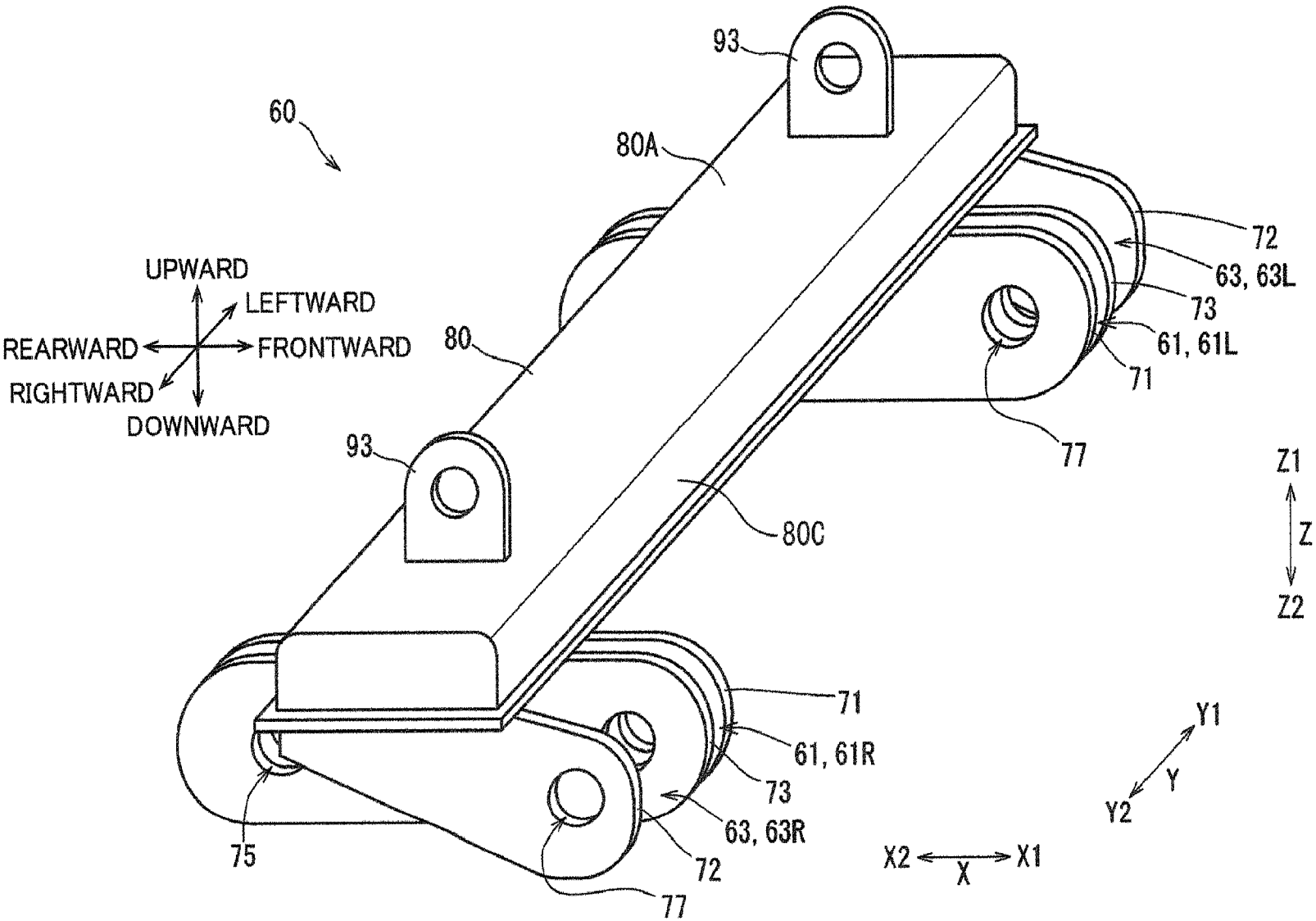
FIG. 6 is a perspective view of the intermediate support holder according to the embodiment of the present invention.

The intermediate support bracket 60 is a member for branching the jib intermediate support lines 50 from the jib guy lines 40 as illustrated in FIG. 2. The pair of right and left jib guy lines 40 and the pair of right and left jib intermediate support lines 50 can be attached to the intermediate support bracket 60. Specifically, the pair of right and left jib guy line intermediate portions 40*m*, and base end portions (intermediate support base end members 51) of the pair of right and left jib intermediate support lines 50 can be attached to the intermediate support bracket 60. As illustrated in FIG. 6, the intermediate support bracket 60 includes a pair of right and left guy line attachment portions 61 (guy line retaining units), a pair of right and left intermediate support attachment portions 63 (intermediate support line retaining units), a transverse member 80 (connecting unit), a pair of front and rear resin pads 91 illustrated in FIG. 9, and a pair of right and left suspension rings 93. As illustrated in FIG. 6, the pair of right and left guy line attachment portions 61 and the pair of right and left intermediate support attachment portions 63 are composed of a pair of right and left first plate members 71, a pair of right and left second plate members 72, and a pair of right and left third plate members 73. The intermediate support bracket 60 is formed of rear pin holes 75 and front pin holes 77.

Figure 4:
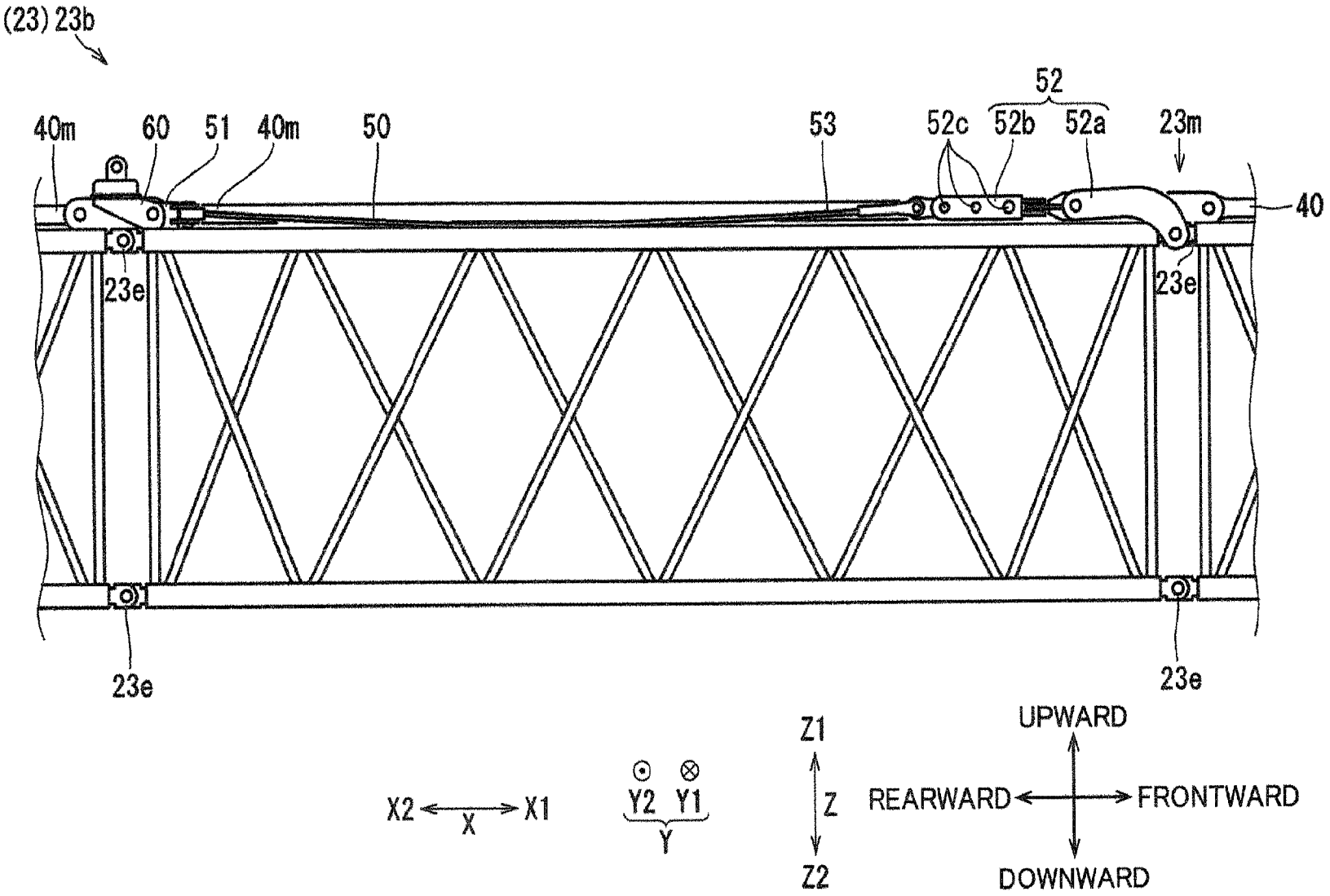
FIG. 4 is a side view of a derricking member and an intermediate support line during assembly of the construction machine illustrated in FIG. 1.
Figure 5:
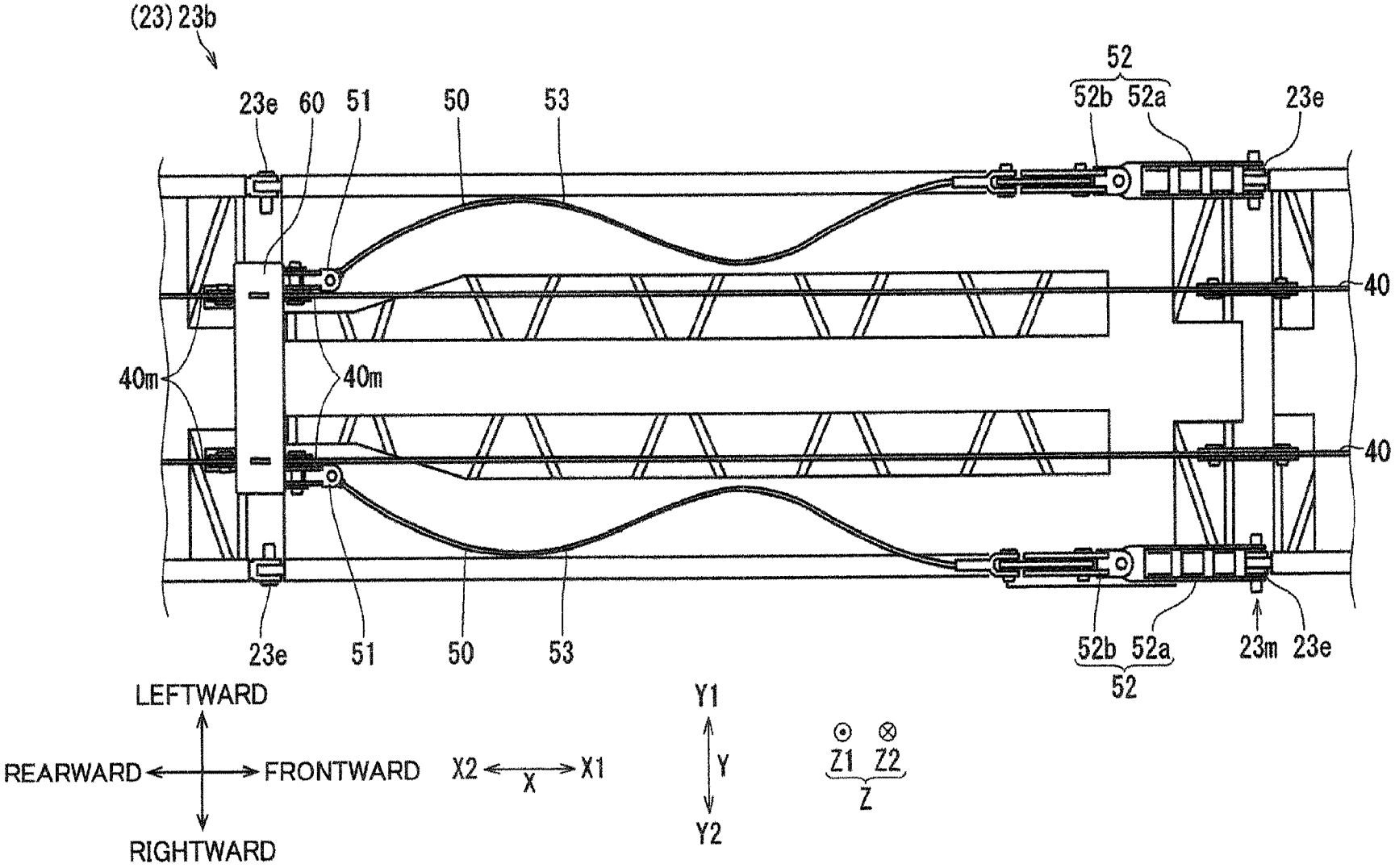
FIG. 5 is a plan view of the derricking member and the intermediate support line during assembly of the construction machine illustrated in FIG. 1.

[On Directions and the like] As illustrated in FIGS. 4 and 5, there is a case where the jib 23 is disposed (laid down) so that the longitudinal direction of the jib 23 becomes a horizontal direction or a substantially horizontal direction, and the intermediate support bracket 60 and the like are mounted on the rear surface (upper surface) of the jib 23 at the time of assembling the jib intermediate support lines 50. Hereinafter, this case will be described. As illustrated in FIG. 5, the longitudinal direction of the jib 23 is defined as a front-rear direction X in this case. In the front-rear direction X, a direction toward the tip end side of the jib 23 is defined as a frontward direction X1, and the opposite direction is defined as a rearward direction X2. One direction in the right-left direction Y is defined as a leftward direction Y1, and the opposite direction is defined as a rightward direction Y2. As illustrated in FIG. 4, a direction orthogonal to the front-rear direction X and the right-left direction Y is defined as an up-down direction Z. In the up-down direction Z, a direction from the jib 23 toward the jib guy lines 40 is defined as an upward direction Z1, and the opposite direction is defined as a downward direction Z2.

Figure 8:
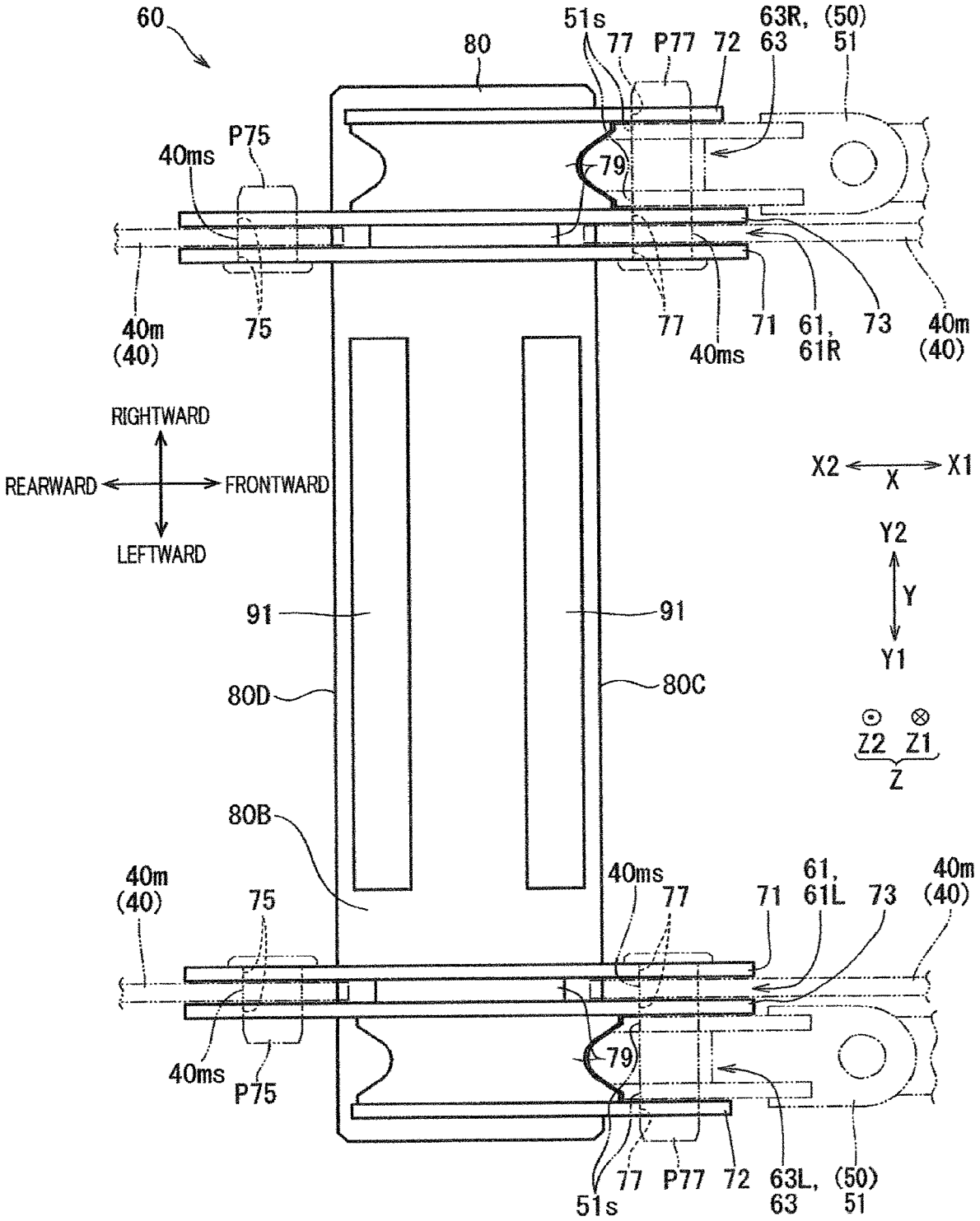
FIG. 8 is a bottom view of the intermediate support holder according to the embodiment of the present invention.

The pair of right and left guy line attachment portions 61 are configured in a manner such that the jib guy line intermediate portions 40*m* of the jib guy lines 40 can be attached to the guy line attachment portions 61 as illustrated in FIG. 8. As a result, the pair of right and left guy line attachment portions 61 can respectively retain the guy line intermediate portions 40*m* of the pair of right and left jib guy lines 40. The guy line attachment portions 61 relay the jib guy lines 40. More specifically, a part of each jib guy line 40 behind a jib guy line intermediate portion 40*m* and a part of each jib guy line 40 ahead of the jib guy line intermediate portion 40*m* can be attached to a guy line attachment portion 61. Each guy line attachment portion 61 is configured to sandwich a jib guy line 40 between a first plate member 71 and a third plate member 73. Each jib guy line 40 can be attached to a guy line attachment portion 61 via a rear pin P75 and a front pin P77. Each jib guy line 40 is rotatable about a rear pin P75 and a front pin P77 (on an axis in the right-left direction Y) with respect to a guy line attachment portion 61. The pair of right and left guy line attachment portions 61 include a left guy line attachment portion 61L and a right guy line attachment portion 61R. The left jib guy line 40 can be attached to the left guy line attachment portion 61L. The right jib guy line 40 can be attached to the right guy line attachment portion 61R.

The pair of right and left intermediate support attachment portions 63 are configured in a manner such that a base end portion (intermediate support base end member 51) of each jib intermediate support line 50 can be attached to an intermediate support attachment portion 63. As a result, the pair of right and left intermediate support attachment portions 63 can respectively retain base end portions of the pair of right and left jib intermediate support lines 50. Each intermediate support attachment portion 63 is configured to sandwich a jib intermediate support line 50 between a second plate member 72 and a third plate member 73. Each jib intermediate support line 50 can be attached to an intermediate support attachment portion 63 via a front pin P77. Each jib intermediate support line 50 is rotatable about a front pin P77 (on an axis in the right-left direction Y) with respect to an intermediate support attachment portion 63. The intermediate support attachment portions 63 are disposed so as to be aligned in the right-left direction Y with respect to the guy line attachment portions 61. For example, the intermediate support attachment portions 63 are disposed so as to be shifted and aligned in the right-left direction Y with respect to the guy line attachment portions 61. The intermediate support attachment portions 63 are disposed (shifted) at positions outer than the guy line attachment portions 61 in the right-left direction Y. It is to be noted that the intermediate support attachment portions 63 may be disposed at positions inner than the guy line attachment portions 61 in the right-left direction Y (which will be described later). The intermediate support attachment portions 63 include a left intermediate support attachment portion 63L and a right intermediate support attachment portion 63R. The left jib intermediate support line 50 can be attached to the left intermediate support attachment portion 63L. The right jib intermediate support line 50 can be attached to the right intermediate support attachment portion 63R.

The pair of right and left first plate members 71 (first retaining members) are plate members that constitute the guy line attachment portions 61 as illustrated in FIG. 6. The first plate members 71 are plates extending in the front-rear direction X and the up-down direction 7 (the same applies to the second plate members 72 and the third plate members 73). The longitudinal directions of the first plate members 71 are the front-rear direction X (the same applies to the second plate members 72 and the third plate members 73).

The pair of right and left second plate members 72 (second retaining members) are plate members that constitute the intermediate support attachment portions 63. The pair of right and left second plate members 72 are disposed respectively at intervals from the pair of right and left first plate members 71 in the right-left direction Y. The pair of right and left second plate members 72 are disposed in parallel with the pair of right and left first plate members 71, and are disposed so as to face the pair of right and left first plate members 71 in the right-left direction Y.

The pair of right and left third plate members 73 (third retaining members) constitute the guy line attachment portions 61 and the intermediate support attachment portions 63. The pair of right and left third plate members 73 are shared by the guy line attachment portions 61 and the intermediate support attachment portions 63. That is, the pair of right and left third plate members 73 constitute the pair of right and left guy line attachment portions 61 together with the pair of right and left first plate members 71, and constitute the pair of right and left intermediate support attachment portions 63 together with the pair of right and left second plate members 72. The pair of right and left third plate members 73 are disposed between the pair of right and left first plate members 71 and the pair of right and left second plate members 72 (in the right-left direction Y). Each third plate member 73 is disposed at an interval from a first plate member 71 in the right-left direction Y, and is disposed at an interval from a second plate member 72 in the right-left direction Y. The third plate members 73 are disposed respectively in parallel with the first plate members 71 and the second plate members 72. The third plate members 73 are disposed so as to face the first plate members 71 in the right-left direction Y. (A part of) each third plate member 73 is disposed so as to face a second plate member 72 in the right-left direction Y.

The rear pin holes 75 are pin holes to which the rear pins P75 are attached as illustrated in FIG. 8. The rear pins P75 are pins for attaching the jib guy lines 40 to the guy line attachment portions 61. The rear pin holes 75 penetrate the first plate members 71 and the third plate members 73 in the right-left direction Y. No rear pin hole 75 is provided at the second plate members 72. Therefore, the second plate members 72 may be smaller than the first plate members 71, and may be smaller than the third plate members 73.

The front pin holes 77 are pin holes to which the front pins P77 are attached. The front pins P77 are pins for attaching the jib guy lines 40 to the guy line attachment portions 61 and attaching the jib intermediate support lines 50 to the intermediate support attachment portions 63. The front pin holes 77 penetrate the first plate members 71, the second plate members 72, and the third plate members 73 in the right-left direction Y.

Figure 7:
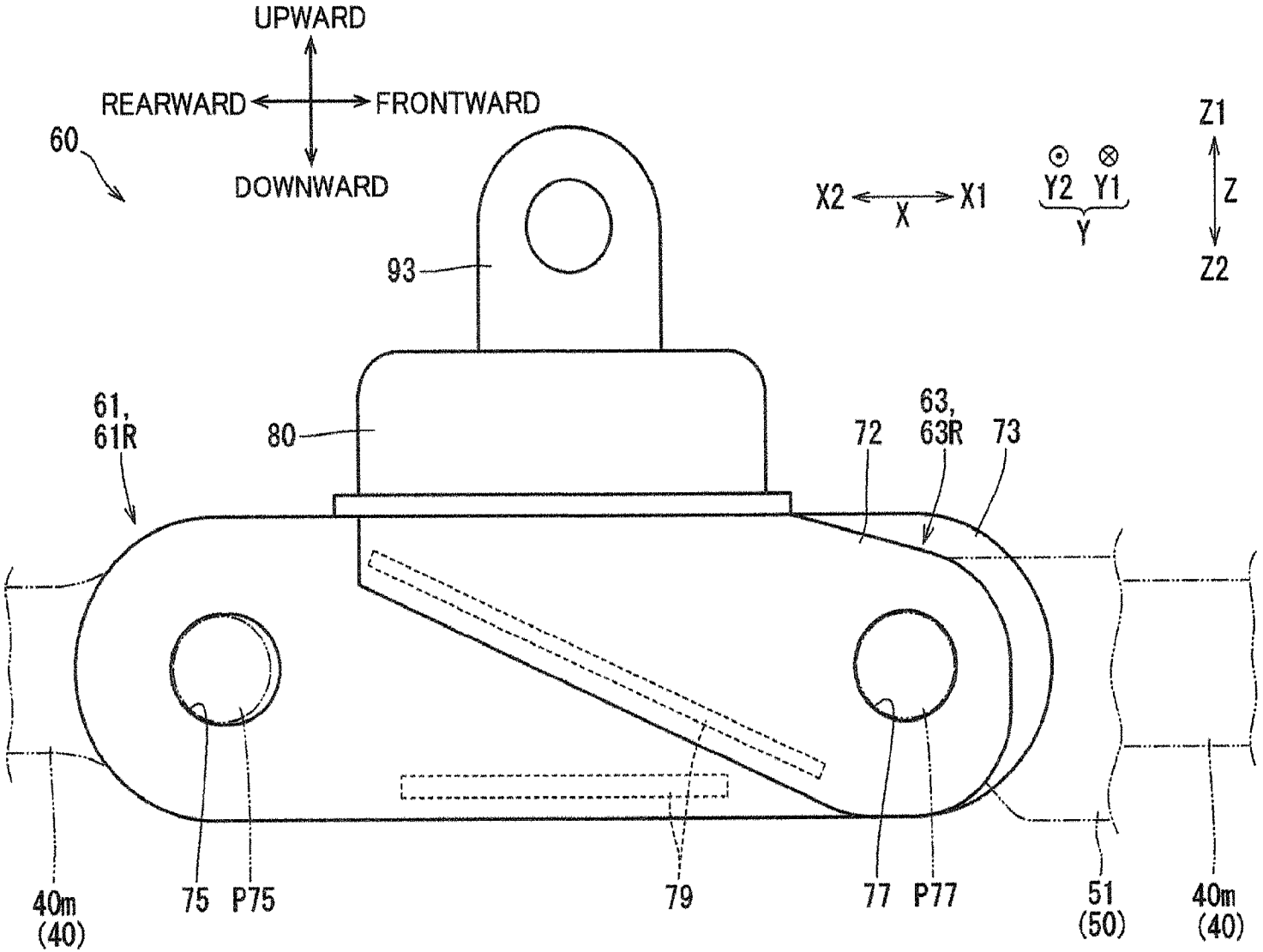
FIG. 7 is a side view of the intermediate support holder according to the embodiment of the present invention.

Coupling plates 79 couple the first plate members 71 and the third plate members 73 adjacent in the right-left direction Y to each other, and couple the third plate members 73 and the second plate members 72 adjacent in the right-left direction Y to each other. As illustrated in FIG. 7, each coupling plate 79 performs the above coupling at a position lower than the transverse member 80.

Figure 9:
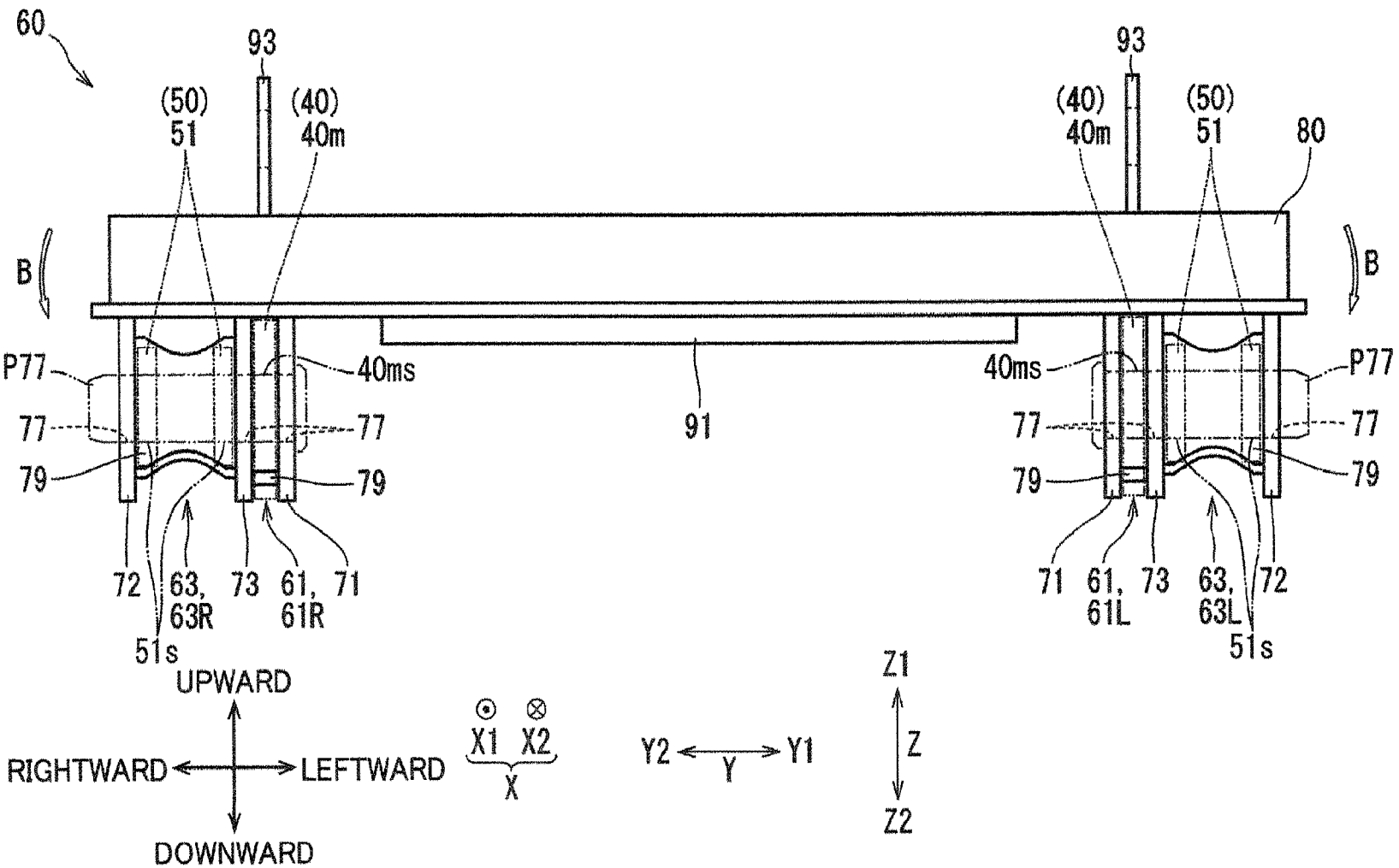
FIG. 9 is a front view of the intermediate support holder according to the embodiment of the present invention.

The transverse member 80 suppresses the twist of the jib guy lines 40 illustrated in FIG. 8, and also suppresses the right and left jib guy lines 40 from widening in the right-left direction Y. The transverse member 80 connects the pair of right and left guy line attachment portions 61 and the pair of right and left intermediate support attachment portions 63 with each other along the right-left direction. Specifically, the transverse member 80 couples and fixes the left guy line attachment portion 61L, the left intermediate support attachment portion 63L, the right guy line attachment portion 61R, and the right intermediate support attachment portion 63R to each other. The transverse member 80 couples and fixes the right and left first plate members 71, the right and left second plate members 72, and the right and left third plate members 73 to each other. As illustrated in FIG. 9, the transverse member 80 is fixed to an upper end portion of each of the first plate members 71, the second plate members 72, and the third plate members 73.

This transverse member 80 has a structure that can secure as much weight reduction and strength enhancement as possible. Specifically, (all or a part of) the transverse member 80 has a box-shaped structure (hollow structure). A box-shaped structure part of the transverse member 80 is provided (continuously) from a left end portion to a right end portion of each of the guy line attachment portions 61 and the intermediate support attachment portions 63. In the example illustrated in FIG. 9, the box-shaped structure part of the transverse member 80 is provided from a position on the left side of the leftmost part of the left intermediate support attachment portion 63L to a position on the right side of the rightmost part of the right intermediate support attachment portion 63R. As illustrated in FIG. 7, a cross section of the transverse member 80 as viewed in the right-left direction is, for example, a square shape or a substantially square shape. That is, the transverse member 80 includes: a first surface 80A extending along the right-left direction; a second surface 80B extending along the right-left direction opposite to the first surface 80A; and a pair of third surfaces 80C and 80D that extend along the right-left direction and connect the first surface 80A and the second surface 80B with each other. It is to be noted that the transverse member 80 needs not have a box-shaped structure. A cross section of the transverse member 80 as viewed from the right-left direction may be, for example, a T shape or an I shape.

As illustrated in FIG. 8, the pair of front and rear resin pads 91 are parts that may come into contact with a wire rope (not shown), and are parts that suppress damage to the wire rope. The wire rope that comes into contact with the resin pads 91 is, for example, a wire rope or the like for vertically moving a hook (not shown) suspended from a tip end portion of the jib 23 illustrated in FIG. 1. As illustrated in FIG. 9, the resin pads 91 are provided on the lower surface (second surface 80B) of the transverse member 80 and protrude downward from the lower surface of the transverse member 80.

The pair of right and left suspension rings 93 are rings for lifting the intermediate support bracket 60 with an assembling crane (not shown) or the like. The suspension rings 93 are provided on the upper surface (first surface 80A) of the transverse member 80 and protrude upward from the upper surface of the transverse member 80.

[On Assembly] The jib intermediate support lines 50 illustrated in FIG. 4 are assembled, for example, as follows. Hereinafter, description will be given along the procedure of assembly. It is to be noted that the procedure of assembly may be changed within a range in which assembly can be achieved.

The jib 23 is disposed, for example, on the ground so that the longitudinal direction of the jib 23 becomes a horizontal direction or a substantially horizontal direction. The pair of right and left jib guy lines 40 are placed on the rear surface (top surface) of the jib 23. When a part of a jib guy line 40 that is to be relayed by the intermediate support bracket 60 is relayed by a link member (see 40V in FIG. 2) or the like, this link member is removed from the jib guy line 40. In this regard, pins (see P40 in FIG. 2) are pulled out from the pair of pin holes opened in the link member.

Next, the intermediate support bracket 60 is placed (deposited) on the rear surface of the jib 23. At this time, the guy line attachment portions 61 (see FIG. 7) are lowered from above (moved downward) with respect to the jib guy lines 40, and are fitted into the jib guy lines 40 (jib guy line intermediate portions 40*m*). As a result, the guy line attachment portions 61 accommodate the jib guy line intermediate portions 40*m*. Here, the left guy line attachment portion 61L and the right guy line attachment portion 61R are coupled to each other by the transverse member 80. Therefore, the right guy line attachment portion 61R can be fitted into the right jib guy line 40 at the same time (or substantially the same time) as when the left guy line attachment portion 61L is fitted into the left jib guy line 40. It is to be noted that the lower surfaces of the pair of right and left first plate members 71, the lower surfaces of the pair of right and left second plate members 72, and the lower surfaces of the pair of right and left third plate members 73 are disposed at the same height as the ground so as to be placed on the rear surface of the jib 23. That is, the pair of right and left first plate members 71, the pair of right and left second plate members 72, and the pair of right and left third plate members 73 protrude downward from the transverse member 80 so that the lower surface portions of the members become flush with each other along the horizontal direction. Moreover, in the process of fitting the guy line attachment portions 61 into the jib guy line intermediate portions 40*m* of the jib guy lines 40, guy line pin holes 40*ms* extending along the right-left direction are formed at the jib guy line intermediate portions 40*m*. As illustrated in FIG. 5, the intermediate support bracket 60 is disposed, for example, near the connectors 23*e* of the jib 23, and is disposed, for example, between the right and left connectors 23*e*. For example, the intermediate support bracket 60 is placed on at least any one of a pipe constituting the rear surface of the jib 23, a member receiver (such as a guy line receiver) that is provided on the rear surface of the jib 23 and is not shown, and a scaffold that is provided on the rear surface of the jib 23 and is not shown.

The intermediate support tip end members 52 are attached to the connectors 23*e* of the jib intermediate portions 23*m* (FIG. 1). It is to be noted that the intermediate support tip end members 52 may be attached to the jib intermediate portions 23*m* before the intermediate support bracket 60 is placed on the rear surface of the jib 23. Furthermore, the intermediate support base end members 51 are fitted into the intermediate support attachment portions 63 (see FIG. 8). It is to be noted that intermediate support pin holes 51*s* (FIG. 8) extending along the right-left direction are formed in advance at the intermediate support base end members 52. As a result, the intermediate support base end members 51 are disposed so as to be aligned in the right-left direction Y with respect to the jib guy line intermediate portions 40*m*. Therefore, the intermediate support base end members 51 are prevented from interfering with the jib guy line intermediate portions 40*m*. Moreover, the intermediate support intermediate members 53 are attached (linked) to the intermediate support base end members 51 and the intermediate support tip end members 52.

As illustrated in FIG. 8, the jib guy lines 40 are attached to the guy line attachment portions 61 by inserting the rear pins P75 into the rear pin holes 75 and the guy line pin holes 40*ms*. Moreover, the front pins P77 are inserted into the front pin holes 77, the intermediate support pin holes 51*s*, and the guy line pin holes 40*ms*. This causes the jib guy lines 40 to be attached to the guy line attachment portions 61, and further causes the jib intermediate support lines 50 (intermediate support base end members 51) to be attached to the intermediate support attachment portions 63. The jib intermediate support lines 50 are assembled as described above.

Regarding the pin holes 77, it is to be noted that the pin holes 77 opened at positions facing each other along the right-left direction are formed at the pair of right and left first plate members 71, the pair of right and left second plate members 72, and the pair of right and left third plate members 73. In addition, the pin holes 77 receive the pins P77 inserted through the guy line pin holes 40*ms* and the intermediate support pin holes 51*s* and allow the jib guy lines 40 and the jib intermediate support lines 50 to be respectively retained by the pins P77 at the guy line attachment portions 61 and the intermediate support attachment portions 63 in a state where the pair of right and left jib guy line intermediate portions 40*m* are respectively disposed between the pair of right and left first plate members 71 and the pair of right and left third plate members 73, and the pair of right and left intermediate support base end members 51 are respectively disposed between the pair of right and left second plate members 72 and the pair of right and left third plate members 73.

In the above work, there is no need to provide a work space between the jib guy line intermediate portions 40*m* and the jib 23 as illustrated in FIG. 4. The jib intermediate support lines 50 can be attached to the intermediate support bracket 60 in a state where the jib guy lines 40 and the intermediate support bracket 60 are placed on the jib 23.

Here, description will be given on problems to occur when a work space is provided between the jib guy line intermediate portions 40*m* and the jib 23 in the process of the work of attaching the jib intermediate support lines 50 to the jib guy lines 40. In order to provide this work space, it is conceivable that the jib 23 illustrated in FIG. 1 is laid down and the front strut 33*a*2 is raised with respect to the jib 23. More specifically, the front strut 33*a*2 is raised in a state where the jib 23 is disposed in a horizontal direction or a substantially horizontal direction, and the jib guy lines 40 are attached to the front strut 33*a*2 and the jib 23. Then, it is considered that a work space is created between the jib guy line intermediate portions 40*m* and the jib 23. However, even with an intension of raising the front strut 33*a*2, the front strut 33*a*2 may possibly interfere with the rear strut 33*a*1, and a sufficient work space may not be secured. Moreover, even if a work space can be secured, it is necessary to attach the jib intermediate support lines 50 to the jib guy lines 40 disposed at positions higher than the jib 23 (floating from or separated from the jib 23). Thus, there is a possibility that the attaching work may take labor as compared with a case where the jib intermediate support lines 50 can be attached to the jib guy lines 40 in a state where the jib guy lines 40 are placed on the rear surface of the jib 23 as in the present embodiment. On the other hand, in the present embodiment, the jib intermediate support lines 50 can be easily attached to the jib guy lines 40 (via the intermediate support bracket 60) in a state where the jib guy lines 40 are placed on the jib 23 as described above as illustrated in FIG. 4.

After the jib intermediate support lines 50 are assembled, the boom 21 is raised with respect to the upper slewing body 13 and the jib 23 is raised with respect to the boom 21 as illustrated in FIG. 1. As a result, the crane 1 is put into a working posture.

[On Force to Act on Intermediate Support Bracket 60 or the like during Crane Work] When the crane 1 is in a working posture (during crane work), tension acts on each of the jib guy lines 40 and the jib intermediate support lines 50 (see tension T40 and tension T50) as illustrated in FIG. 3.

During crane work, the jib intermediate support lines 50 are disposed on outer sides in the right-left direction Y (the interval between the two jib intermediate support lines 50 in the right-left direction Y becomes wider) with the distance from the base end side (intermediate support bracket 60 side) toward the tip end side. Thus, the intermediate support attachment portions 63 receive outward force in the right-left direction Y due to the tension T50 of the jib intermediate support lines 50. Thus, if the transverse member 80 illustrated in FIG. 8 is not provided, the outward force in the right-left direction Y to act on the intermediate support attachment portions 63 is applied to the right and left jib guy lines 40 via the guy line attachment portions 61. In addition, the right and left jib guy lines 40 are widened outward in the right-left direction Y. Accordingly, in the present embodiment, the transverse member 80 couples and fixes the left guy line attachment portion 61L, the left intermediate support attachment portion 63L, the right guy line attachment portion 61R, and the right intermediate support attachment portion 63R to each other. Therefore, it is possible to suppress the jib guy lines 40 from widening outward in the right-left direction Y.

Moreover, during crane work, the jib intermediate support lines 50 are disposed so as to move away from the jib guy lines 40 and approach the jib 23 with the distance from the base end side (intermediate support bracket 60 side) toward the tip end side as illustrated in FIG. 2. Thus, the inter mediate support attachment portions 63 illustrated in FIG. 9 receive force toward the jib 23 (downward in FIG. 9) due to the tension T50 (see FIG. 2) of the jib inter mediate support lines 50. Thus, if the transverse member 80 is not provided, the intermediate support attachment portions 63 tend to be displaced toward the jib 23 side with respect to the guy line attachment portions 61 and the jib guy line intermediate portions 40*m*. Then, the jib guy lines 40 are twisted. Accordingly, in the present embodiment, the transverse member 80 couples and fixes the left guy line attachment portion 61L, the left intermediate support attachment portion 63L, the right guy line attachment portion 61R, and the right intermediate support attachment portion 63R to each other. Therefore, the twist of the jib guy lines 40 can be suppressed.

[Effects] The effects of the intermediate support bracket 60 illustrated in FIG. 8 are as follows.

The pair of right and left jib guy lines 40 (guy lines) and the pair of right and left jib intermediate support lines 50 (intermediate supports) can be attached to the intermediate support bracket 60. As illustrated in FIG. 1, the jib guy lines 40 are attached to a tip end portion of the jib 23 (attachment). The jib intermediate support lines 50 are attached to intermediate portions of the jib guy lines 40 (jib guy line intermediate portions 40*m*) and an intermediate portion of the jib 23 (jib intermediate portion 23*m*). As illustrated in FIG. 8, the intermediate support bracket 60 includes the pair of right and left guy line attachment portions 61, the pair of right and left intermediate support attachment portions 63, and the transverse member 80.

Intermediate portions of the jib guy lines 40 (jib guy line intermediate portions 40*m*) can be attached to the guy line attachment portions 61. The intermediate support attachment portions 63 are disposed so as to be aligned in the right-left direction Y with respect to the guy line attachment portions 61, and base end portions of the jib intermediate support lines 50 can be attached to the intermediate support attachment portions 63.

The transverse member 80 couples and fixes the left guy line attachment portion 61L, the left intermediate support attachment portion 63L, the right guy line attachment portion 61R, and the right intermediate support attachment portion 63R to each other.

With the above configuration, base end portions of the jib intermediate support lines 50 can be attached to the jib guy line intermediate portions 40*m* via the intermediate support bracket 60 so as to be aligned in the right-left direction Y with respect to the jib guy line intermediate portions 40*m*. Therefore, there is no need to provide a work space between the jib guy line intermediate portions 40*m* and the jib 23 when base end portions of the jib intermediate support lines 50 are attached to the jib guy line intermediate portions 40*m* as illustrated in FIG. 4. Therefore, even if there is no work space between the jib guy line intermediate portions 40*m* and the jib 23, the jib intermediate support lines 50 can be easily attached to the jib guy lines 40. As a result, the labor for the work of attaching the jib intermediate support lines 50 to the jib guy lines 40 can be reduced.

Moreover, in the above configuration, base end portions of the jib intermediate support lines 50 can be disposed so as to be aligned in the right-left direction Y with respect to the jib guy line intermediate portions 40*m* as illustrated in FIG. 8. Moreover, when the crane 1 (see FIG. 1) is in a working posture, the intermediate support attachment portions 63 illustrated in FIG. 9 receive force toward the jib 23 side (downward in FIG. 9) due to the tension T50 (see FIG. 2) of the jib intermediate support lines 50. Thus, if the transverse member 80 is not provided, the intermediate support attachment portions 63 tend to be displaced toward the jib 23 side with respect to the guy line attachment portions 61 and the jib guy line inter mediate portions 40*m*. Then, the jib guy lines 40 are twisted. Accordingly, in the above configuration, the transverse member 80 couples and fixes the left guy line attachment portion 61L, the left intermediate support attachment portion 63L, the right guy line attachment portion 61R, and the right inter mediate support attachment portion 63R to each other. Therefore, the twist of the jib guy lines 40 can be suppressed.

As illustrated in FIG. 6, the intermediate support bracket 60 includes the pair of right and left first plate members 71, the pair of right and left second plate members 72, and the pair of right and left third plate members 73. The first plate members 71 constitute the guy line attachment portions 61. Each second plate member 72 constitutes an intermediate support attachment portion 63, and is disposed at an interval from a first plate member 71 in the right-left direction. Each third plate member 73 constitutes a guy line attachment portion 61 and an intermediate support attachment portion 63, and is disposed between a first plate member 71 and a second plate member 72.

In the above configuration, the third plate members 73 are used for both the guy line attachment portions 61 and the intermediate support attachment portions 63. Therefore, the number of members constituting the intermediate support bracket 60 can be reduced as compared with a case where there is no member that is used for both the guy line attachment portions 61 and the intermediate support attachment portions 63. Thus, the intermediate support bracket 60 can be configured simply, and the weight of the intermediate support bracket 60 can be reduced.

As illustrated in FIG. 8, the inter mediate support bracket 60 has front pin holes 77 (pin holes). The front pin holes 77 penetrate the first plate members 71, the second plate members 72, and the third plate members 73 in the right-left direction Y. The front pins P77 for attaching the jib guy lines 40 and the jib intermediate support lines 50 to the intermediate support bracket 60 can be inserted into the front pin holes 77.

In the above configuration, the jib intermediate support lines 50 can be attached to the intermediate support bracket 60 by inserting the front pins P77 into the front pin holes 77 and the guy line pin holes 40*ms*. Furthermore, the jib guy lines 40 can be attached to the intermediate support bracket 60 by inserting the front pins P77 into the front pin holes 77, the intermediate support pin holes 51*s*, and the guy line pin holes 40*ms*. Therefore, the number of pins can be reduced and the labor for attaching and detaching the pins can be suppressed as compared with a case where there is no pin used for both the attachment of the jib intermediate support lines 50 and the attachment of the jib guy lines 40.

As illustrated in FIG. 9, the transverse member 80 has a box-shaped structure.

In the above configuration, when the crane 1 (see FIG. 1) is in a working posture, the right and left intermediate support attachment portions 63 receive force toward the jib 23 (downward in FIG. 9) due to the tension T50 (see FIG. 2) of the jib intermediate support lines 50. Therefore, this force is transmitted to the transverse member 80 via the right and left intermediate support attachment portions 63. As a result, bending force B acts on the transverse member 80 (FIG. 9). Accordingly, in the above configuration, the transverse member 80 has a box-shaped structure. Therefore, the weight of the transverse member 80 can be reduced while securing the strength against bending of the transverse member 80 as compared with, for example, a case where the transverse member 80 is constituted only of a plate-like structure or the like.

(Variations)

The above embodiment may be variously modified. For example, the arrangement or shape of each component may be changed. For example, the number of components may be changed, and some of the components need not be provided. For example, at least any one of the resin pads 91 and the suspension rings 93 needs not be provided.

In the above embodiment, the intermediate support bracket 60 is attached to the jib guy line intermediate portions 40*m* and base end portions of the jib intermediate support lines 50 as illustrated in FIG. 1. On the other hand, the intermediate support bracket 60 (160) may be attached to at least any one of the jib guy lines 40 and the boom guy lines 31*g*. The intermediate support bracket 160 (intermediate support holder) may be attached to an intermediate portion 131*gm* (corresponding to a guy line intermediate portion) and a boom intermediate support 131*i* (corresponding to a derricking member intermediate portion) of the pair of right and left boom guy lines 31*g*. In this case, the boom 21 constitutes a derricking member, and the boom support member 31 constitutes a derricking device. Moreover, the pair of right and left boom guy lines 31*g* constitute an intermediate support line.

In the above embodiment, a case where the jib 23 is disposed in a manner such that the longitudinal direction of the jib 23 becomes parallel to a horizontal direction or a substantially horizontal direction at the time of assembling the jib intermediate support lines 50 illustrated in FIG. 4 has been described. On the other hand, at the time of assembling the jib intermediate support lines 50, the longitudinal direction of the jib 23 may not be parallel to a horizontal direction or a substantially horizontal direction. Moreover, the front-rear direction X (frontward direction X1 rearward direction X2), the up-down direction Z (upward direction Z1, downward direction Z2), the leftward direction Y1, the rightward direction Y2, and the like are merely directions used for convenience of description. For example, the frontward direction X1 and the rearward direction X2 may be reversed, and the leftward direction Y1 and the rightward direction Y2 may be reversed. The up-down direction Z may not be the vertical direction, and may be a direction inclined with respect to the vertical direction.

In the above embodiment, tip end portions (intermediate support tip end members 52) of the jib intermediate support lines 50 are disposed at positions outer than base end portions (intermediate support base end members 51) in the right-left direction Y as illustrated in FIG. 3. Moreover, the intermediate support attachment portions 63 illustrated in FIG. 8 are disposed at positions outer than the guy line attachment portions 61 in the right-left direction Y. On the other hand, the positions of tip end portions of the jib intermediate support lines 50 in the right-left direction Y illustrated in FIG. 3 may be the same as the positions of base end portions of the jib intermediate support lines 50 in the right-left direction Y, or may be positions inner than the base end portions of the jib intermediate support lines 50 in the right-left direction Y. Moreover, the intermediate support attachment portions 63 illustrated in FIG. 8 may be disposed at positions inner than the guy line attachment portions 61 in the right-left direction Y.

The present invention provides an intermediate support holder for a construction machine, the intermediate support holder being configured to be mounted in a construction machine including: a derricking member that includes a derricking member base end portion, a derricking member tip end portion opposite to the derricking member base end portion, and a derricking member intermediate portion located between the derricking member base end portion and the derricking member tip end portion and is supported at a body so as to be able to derrick; a derricking device that has a pair of right and left guy lines each including a guy line tip end portion connected with the derricking member tip end portion of the derricking member, a guy line base end portion opposite to the guy line tip end portion, and a guy line intermediate portion located between the guy line base end portion and the guy line tip end portion and causes the derricking member to derrick; and a pair of right and left intermediate support lines that each have an intermediate support base end portion coupled to the guy line intermediate portion of each of the guy lines, and an intermediate support tip end portion coupled to the derricking member intermediate portion of the derricking member and connect the pair of right and left guy line intermediate portions and the derricking member intermediate portion with each other. The intermediate support holder includes: a pair of right and left guy line retaining units that can respectively retain the guy line intermediate portions of the pair of right and left guy lines; a pair of right and left intermediate support line retaining units that are respectively disposed adjacent to the pair of right and left guy line retaining units in a right-left direction and can respectively retain the intermediate support base end portions of the pair of right and left intermediate support lines; and a connecting unit that connects the pair of right and left guy line retaining units and the pair of right and left intermediate support line retaining units with each other along the right-left direction.

The above configuration preferably includes: a pair of right and left first retaining members; a pair of right and left second retaining members disposed at an interval in the right-left direction with respect to the pair of right and left first retaining members; and a pair of right and left third retaining members respectively disposed between the pair of right and left first retaining members and the pair of right and left second retaining members in the right-left direction, the pair of right and left third retaining members constituting the pair of right and left guy line retaining units together with the pair of right and left first retaining members, and constituting the pair of right and left intermediate support line retaining units together with the pair of right and left second retaining members.

In the above configuration, it is preferable that a guy line pin hole extending along the right-left direction is formed at each of the guy line intermediate portions of the pair of right and left guy lines, an intermediate support pin hole extending along the right-left direction is formed at each of the intermediate support base end portions of the pair of right and left intermediate support lines, and holder pin holes that are opened at positions facing each other in the right-left direction, receive pins inserted through the guy line pin holes and the intermediate support pin holes in a state where the pair of right and left guy line intermediate portions are respectively disposed between the pair of right and left first retaining members and the pair of right and left third retaining members, and the pair of right and left intermediate support base end portions are respectively disposed between the pair of right and left second retaining members and the pair of right and left third retaining members, and allow the guy lines and the intermediate support lines to be respectively retained by the pins at the guy line retaining unit and the intermediate support line retaining unit are formed at the pair of right and left first retaining members, the pair of right and left second retaining members, and the pair of right and left third retaining members.

In the above configuration, the connecting unit preferably has a box-shaped structure including: a first surface extending along the right-left direction; a second surface extending along the right-left direction opposite to the first surface; and a pair of third surfaces that extend along the right-left direction and connect the first surface and the second surface with each other.

The invention claimed is:

1. An intermediate support holder for a construction machine, the intermediate support holder being configured to be mounted in a construction machine including:

a derricking member that includes a derricking member base end portion, a derricking member tip end portion opposite to the derricking member base end portion, and a derricking member intermediate portion located between the derricking member base end portion and the derricking member tip end portion and is supported at a body so as to be able to derrick;

a derricking device that has a pair of right and left guy lines each including a guy line tip end portion connected with the derricking member tip end portion of the derricking member, a guy line base end portion opposite to the guy line tip end portion, and a guy line intermediate portion located between the guy line base end portion and the guy line tip end portion and causes the derricking member to derrick; and a pair of right and left intermediate support lines that each have an intermediate support base end portion coupled to the guy line intermediate portion of each of the guy lines, and an intermediate support tip end portion coupled to the derricking member intermediate portion of the derricking member and connect the pair of right and left guy line intermediate portions and the derricking member intermediate portion with each other, the intermediate support holder comprising:

a pair of right and left guy line retaining units that can respectively retain the guy line intermediate portions of the pair of right and left guy lines;

a pair of right and left intermediate support line retaining units that are respectively disposed adjacent to the pair of right and left guy line retaining units in a right-left direction and can respectively retain the intermediate support base end portions of the pair of right and left intermediate support lines;

a connecting unit that connects the pair of right and left guy line retaining units and the pair of right and left intermediate support line retaining units with each other along the right-left direction;

a pair of right and left first retaining members;

a pair of right and left second retaining members disposed at an interval in the right-left direction with respect to the pair of right and left first retaining members; and a pair of right and left third retaining members respectively disposed between the pair of right and left first retaining members and the pair of right and left second retaining members in the right-left direction, the pair of right and left third retaining members constituting the pair of right and left guy line retaining units together with the pair of right and left first retaining members, and constituting the pair of right and left intermediate support line retaining units together with the pair of right and left second retaining members.

2. The intermediate support holder for a construction machine according to claim 1, wherein a guy line pin hole extending along the right-left direction is formed at each of the guy line intermediate portions of the pair of right and left guy lines, an intermediate support pin hole extending along the right-left direction is formed at each of the intermediate support base end portions of the pair of right and left intermediate support lines, and holder pin holes that are opened at positions facing each other in the right-left direction, receive pins inserted through the guy line pin holes and the intermediate support pin holes in a state where the pair of right and left guy line intermediate portions are respectively disposed between the pair of right and left first retaining members and the pair of right and left third retaining members, and the pair of right and left intermediate support base end portions are respectively disposed between the pair of right and left second retaining members and the pair of right and left third retaining members, and allow the guy lines and the intermediate support lines to be respectively retained by the pins at the guy line retaining units and the intermediate support line retaining units are formed at the pair of right and left first retaining members, the pair of right and left second retaining members, and the pair of right and left third retaining members.

3. The intermediate support holder for a construction machine according to claim 1, wherein the connecting unit has a box-shaped structure including: a first surface extending along the right-left direction; a second surface extending along the right-left direction opposite to the first surface; and a pair of third surfaces that extend along the right-left direction and connect the first surface and the second surface with each other.

* * * * *